US005893524A

United States Patent [19]

Schwelling

[11] Patent Number: 5,893,524

[45] Date of Patent: Apr. 13, 1999

[54] PAPER SHREDDER

[76] Inventor: Hermann Schwelling, Hartmannweg 5, 88682 Salem, Germany

[21] Appl. No.: 08/760,650

[22] Filed: Dec. 4, 1996

[30] Foreign Application Priority Data

Dec. 4, 1995 [DE] Germany ..... 195 45 087

[51] Int. Cl.[6] ..... B02C 4/08

[52] U.S. Cl. ..... 241/167; 241/236; 241/285.1; 241/DIG. 30

[58] Field of Search ..... 241/100, 236, 241/DIG. 30, 167, 285.1

[56] References Cited

U.S. PATENT DOCUMENTS

| | | | |
|---|---|---|---|
| 4,285,473 | 8/1981 | Williams | 241/37.5 |
| 5,167,374 | 12/1992 | Strohmeyer | 241/36 |
| 5,230,477 | 7/1993 | Strohmeyer | 241/166 |
| 5,346,144 | 9/1994 | Stangenberg et al. | 241/100 |
| 5,478,020 | 12/1995 | Chamber, Sr. et al. | 241/236 |
| 5,511,732 | 4/1996 | Kroger et al. | 241/166 |
| 5,660,339 | 8/1997 | Scott et al. | 241/60 |

*Primary Examiner*—John M. Husar
*Attorney, Agent, or Firm*—Friedrich Kueffner

[57] ABSTRACT

A paper shredder, particularly a small paper shredder, includes a shell-like lower housing part which includes the cutting rollers with their bearing plates at the end faces and the stripping elements, and an upper housing part which is provided with a material inlet slot and can be placed on the lower housing part. The bearing plate on the drive side for the cutting rollers simultaneously forms the single-piece bottom of an also shell-like gear housing which can be closed by means of a cover. The entire cutting mechanism including gear housing, cutting rollers and stripping elements is mounted in the area of the bearing plates on the end faces through vibration-damping elements in the lower housing part.

10 Claims, 2 Drawing Sheets

PAPER SHREDDER

BACKGROUND OF THE INVENTION

1. Field of the Invention

The present invention relates to a paper shredder, particularly a small paper shredder. The paper shredder includes a shell-like lower housing part which includes the cutting rollers with their bearing plates at the end faces and the stripping elements, and an upper housing part which is provided with a material inlet slot and can be placed on the lower housing part.

2. Description of the Related Art

Small paper shredding apparatus of the above-described type are known, for example, from DE 40 08 654 A1 and include a two-part injection-molded housing of synthetic material in which, in addition, the usually web-shaped stripping elements including the cutting roller bearings are integrated in the housing during injection molding. Although this apparatus can be easily assembled, there is the disadvantage that these known apparatus do not run smoothly and are loud during operation because all drive and work noises are transmitted as vibrations to the housing which additionally acts as an amplifying sound board.

SUMMARY OF THE INVENTION

Therefore, it is the primary object of the present invention to provide a small paper shredder which is extremely simple to assemble, which produces extremely little structure-borne noise radiation and runs very smoothly.

In accordance with the present invention, the bearing plate on the drive side for the cutting rollers simultaneously forms the single-piece bottom of an also shell-like gear housing which can be closed by means of a cover. The entire cutting mechanism including gear housing, cutting rollers and stripping elements is mounted in the area of the bearing plates on the end faces through vibration-damping elements in the lower housing part.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
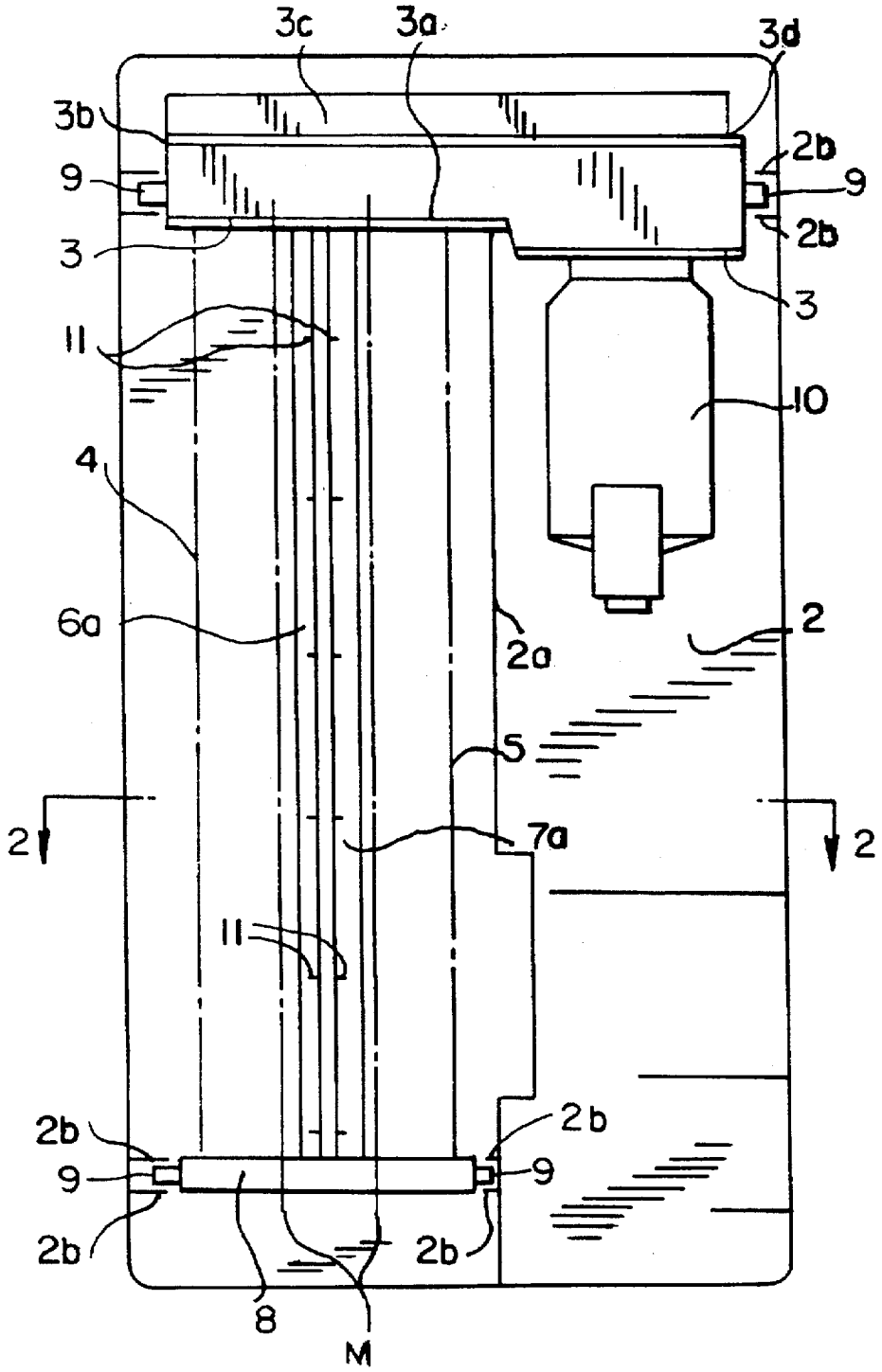
FIG. 1 is a schematic top view of the lower part of an open paper shredder housing.
Figure 2:
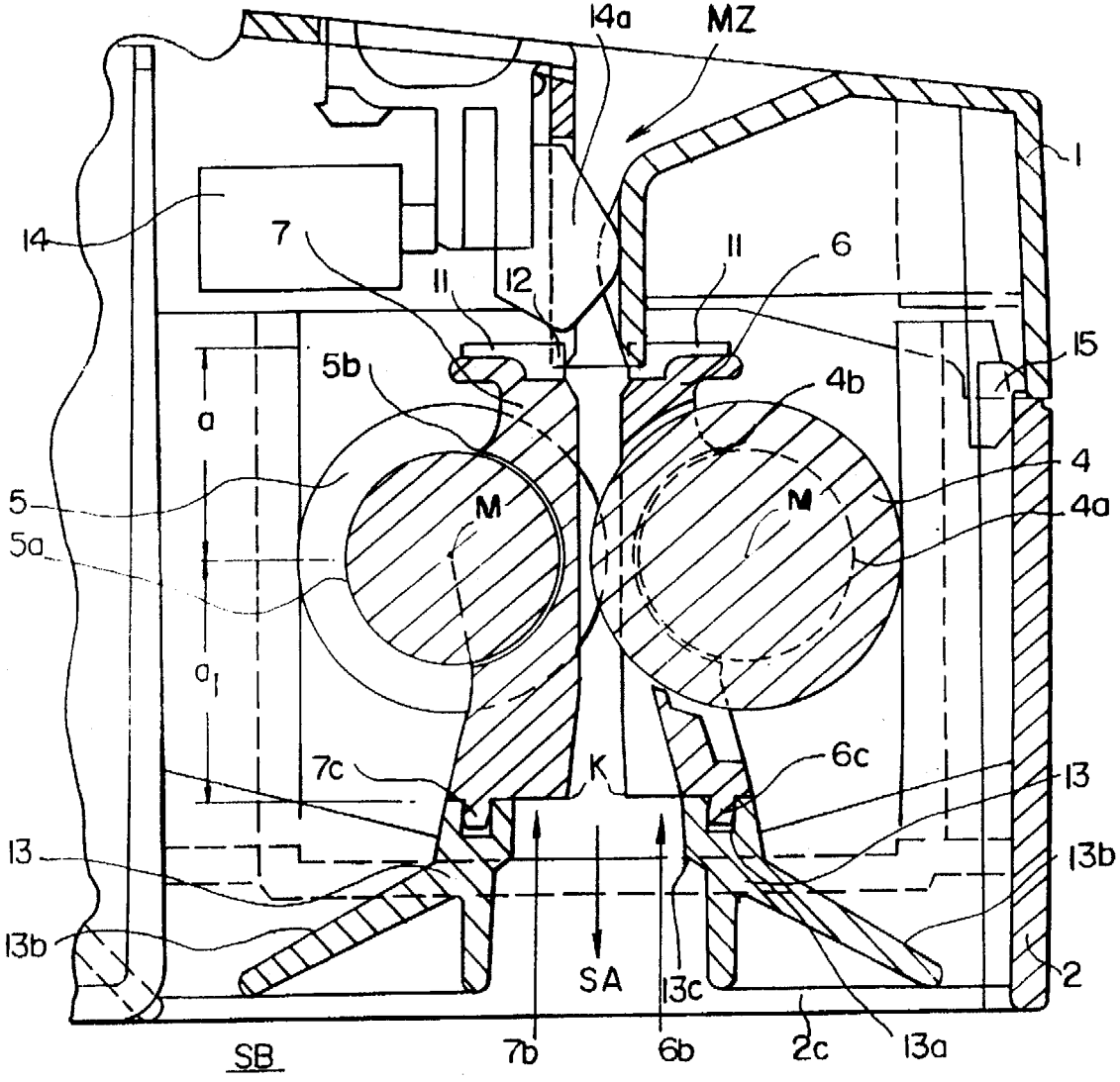
FIG. 2 is a cross-sectional view, on a larger scale, taken along sectional line A—A of FIG. 1.

A paper shredder according to the present invention, particularly a small paper shredder, is composed in its basic construction of a shell-like lower housing part 2 which includes the cutting rollers 4, 4*a* and 5, 5*a* together with their bearing plates 3 and 8 at the end faces, the corresponding stripping elements 6 and 7 as well as the outlet gap SA for the cut material, and an upper housing part 1 provided with an inlet gap MZ for the material to be cut, wherein the upper housing part 1 can be placed on the lower housing part 2.

The essential feature for meeting the above-described object in such a paper shredding apparatus is the fact that, according to the present invention, the bearing plate 3 on the drive side for the cutting rollers 4, 5 simultaneously forms a single-piece bottom 3*a* of an also shell-like gear housing 3, 3*a*, 3*b* which can be closed by means of a cover 3*c*, and that the entire cutting mechanism including gear housing 3, cutting rollers 4, 5 and stripping elements 6, 7 is mounted in the area of the bearing plates 3 and 8 on the end faces through vibration-damping elements 9 in the lower part 2 of the housing.

As a result of the two principal features according to the present invention, the entire cutting mechanism unit has a high inherent stability and manufacturing accuracy, and, due to the vibration-damping acoustic uncoupling from the housing, the cutting mechanism unit practically has no structure-borne sound radiation and, thus, the unit operates extremely smoothly and quietly.

In accordance with another further development of the present invention, the cutting rollers 4, 4*a* and 5, 5*a* and their comb-like stripping ledges 6, 7 are connected to the two bearing plates 3 and 8 on the end faces in a positively locking and/or frictionally locking manner by insertion in appropriate recesses; consequently, the apparatus is constructed in such a way that it is extremely simple to assembly and maintain; in addition, individual structural groups can be prefabricated and assembled later.

In accordance with another feature according to the present invention which is important with respect to the operation of the cutting mechanism, the stripping ledges 6, 7 are of a synthetic slide bearing material and rest on the cutting edges 4, 5 while being in close contact with the cores 4*a* and 5*a* of the cutting rollers, and the free ends 4*b* and 5*b* of the stripping elements 6 and 7 on the roller cores 4*a* and 5*b* are constructed nose-shaped with pointed ends. This produces the necessary stability of the comb-like stripping elements.

In order to prevent paper from reaching the gap between the cutting mechanism and the upper housing part 1 when material is inserted into the apparatus and particularly when the rollers rotate backwardly, another feature of the present invention provides that the surfaces 6*a* and 7*a* of the stripping ledges 6 and 7 have over their entire lengths transverse webs 11 arranged at a distance opposite each other, and the upper housing part 1 has corresponding recesses 12, wherein the transverse webs 11 engage in the recesses 12 without contacting the recesses 12, so that they are acoustically uncoupled from each other.

In accordance with another important feature of the cutting mechanism, the bottom sides 6*b* and 7*b* of the stripping ledges 6 and 7 each have a longitudinal web 6*c* and 7*c* which engages in corresponding recesses 13*a* of the longitudinal housing girders 13 at the bottom, wherein the girders 13 are located in the open bottom area 2*c* of the lower housing part 2 and include guide surfaces 13*b* which extend from the cutting rollers 4, 5 obliquely toward the bottom. On the one hand, this configuration prevents dust and cutting material particles from being clogged in the housing area; in addition, since small units of this type generally do not have an automatic switch-off when the collecting container is filled, cut material is prevented from penetrating into the cutting mechanism from below when the receiving container SB is full; this effect is further reinforced by means of an obstacle-like step 13*c* at the bottom side of the longitudinal girders 13 and the protruding configurations of the corners or edges K of the stripping ledges 6 and 7 in the area of the cut material outlet gap SA. Moreover, these longitudinal edges K of the stripping ledges 6 and 7 are located, in relation to the center axis M of the cutting rollers, at a distance $s_1$ below the center axes M which is greater than the dimension a between the center axes M and the upper surfaces 6*a* and 7*a* of the stripping elements.

The paper shredding apparatus according to the present invention is operationally completed by an on/off switch 14 together with a switching vane 14*a* which projects into the material inlet gap MZ and serves for the automatic start-up of the cutting mechanism when material is inserted.

The invention is not limited by the embodiments described above which are presented as examples only but can be modified in various ways within the scope of protection defined by the appended patent claims.

I claim:

1. A paper shredder comprising a lower housing part, cutting rollers with bearing plates at end faces thereof and stripping elements mounted in the lower housing part, wherein the stripping elements are comb-like stripping ledges, the cutting rollers and the stripping ledges being connected in at least one of a frictional engagement and a positive engagement to the bearing plates by being inserted in corresponding recesses of the bearing plates, an upper housing part having a material inlet gap, the upper housing part being placable on the lower housing part, one of the bearing plates on a drive side for the cutting rollers forming a single-piece bottom of a shell-like gear housing, a cover for closing the gear housing, and vibration-damping elements in the lower part of the housing at the bearing plates, wherein the gear housing, the cutting rollers and the stripping elements forming a cutting mechanism are supported through the vibration-damping element in the lower housing part.

2. The paper shredder according to claim 1, wherein the stripping ledges are of a synthetic slide bearing material, the cutting rollers having roller cores, wherein the stripping ledges rest on the cutting rollers in close contact with the cutting roller cores.

3. The paper shredder according to claim 2, wherein free ends of contact areas of the stripping ledges on the roller cores are constructed nose-shaped with pointed ends.

4. The paper shredder according to claim 1, wherein the stripping ledges have upper surfaces, the upper surfaces having over an entire length of the stripping ledges transverse webs arranged at a distance opposite each other, and wherein the upper housing part has corresponding recesses, wherein the transverse webs engage in the recesses without contact so as to be acoustically uncoupled.

5. The paper shredder according to claim 1, wherein the stripping ledges have bottom sides, the bottom sides of the stripping ledges each having a longitudinal web, the housing having longitudinal girders at a bottom of the housing, the longitudinal girders each having a recess for receiving the longitudinal webs.

6. The paper shredder according to claim 5, wherein the longitudinal housing girders are located in an open bottom area of the lower housing part and include guide surfaces extending obliquely downwardly from the cutting rollers.

7. The paper shredder according to claim 5, wherein each longitudinal housing girder comprises at an underside thereof an obstruction-like step and an additional protruding corner configuration of edges of the bottom sides of the stripping ledges in an area of an outlet gap for cut material.

8. The paper shredder according to claim 7, wherein a distance between center axes of the cutting rollers and the edges of the stripping ledges is greater than a distance between the center axes of the cutting rollers and the upper surfaces of the stripping ledges.

9. The paper shredder according to claim 1, comprising an on/off switch in the upper housing part including a switching vane protruding into the material inlet gap.

10. The paper shredder according to claim 1, comprising snap-in elements for connecting the upper housing part to the lower housing part.

* * * * *